US012215512B2

(12) United States Patent
Cigala et al.

(10) Patent No.: US 12,215,512 B2
(45) Date of Patent: Feb. 4, 2025

(54) PUSH-PULL PROP

(71) Applicant: COMIPONT S.P.A., Porzano di Leno (IT)

(72) Inventors: Marco Cigala, Porzano di Leno (IT); Alberto Rampini, Porzano di Leno (IT)

(73) Assignee: COMIPONT S.P.A., Porzano di Leno (IT)

( * ) Notice: Subject to any disclaimer, the term of this patent is extended or adjusted under 35 U.S.C. 154(b) by 253 days.

(21) Appl. No.: 17/801,150

(22) PCT Filed: Jun. 23, 2021

(86) PCT No.: PCT/IB2021/055525
§ 371 (c)(1),
(2) Date: Aug. 19, 2022

(87) PCT Pub. No.: WO2021/260564
PCT Pub. Date: Dec. 30, 2021

(65) Prior Publication Data

US 2023/0075809 A1 Mar. 9, 2023

(30) Foreign Application Priority Data

Jun. 26, 2020 (IT) ..... 102020000015427

(51) Int. Cl.
*E04G 21/26* (2006.01)
*E04G 25/06* (2006.01)
*E04G 25/00* (2006.01)

(52) U.S. Cl.
CPC ..... *E04G 21/26* (2013.01); *E04G 25/06* (2013.01); *E04G 2025/006* (2013.01)

(58) Field of Classification Search
CPC .... E04G 21/26; E04G 25/06; E04G 2025/006
(Continued)

(56) References Cited

U.S. PATENT DOCUMENTS 2,725,210 A * 11/1955 Swartz ..... E04G 13/00 248/354.3
3,204,910 A * 9/1965 Gacher ..... B63C 5/02 269/74

(Continued)

OTHER PUBLICATIONS

International Search Report and Written Opinion dated Oct. 7, 2021 from counterpart International Patent Application No. PCT/IB2021/055525.

*Primary Examiner* — Paola Agudelo
(74) *Attorney, Agent, or Firm* — NIXON & VANDERHYE

(57) ABSTRACT

A push-pull prop includes inner and outer tubes reversibly fixed to each other, a threaded bar screwed into a threaded portion of a first end of the inner tube, a fixing head including a coupling portion fixable to a first end of the outer tube and a locking portion rotationally connected to the coupling portion, so the outer tube can rotate with respect to the locking portion about a rotation axis to thread the inner tube on the threaded bar. The locking portion is rotationally connected to a first connecting element at a first surface so the prop can rotate about a first tilting axis perpendicular to the rotation axis. The threaded bar is rotationally connected to a second connecting element at a second surface, so the prop can rotate about a second tilting axis perpendicular to the rotation axis and parallel to the first tilting axis.

8 Claims, 3 Drawing Sheets

(58) Field of Classification Search
USPC ..... 52/127.2
See application file for complete search history.

(56) References Cited

U.S. PATENT DOCUMENTS

| | | | | |
|---|---|---|---|---|
| 3,229,950 | A * | 1/1966 | MacRobbie | E04G 21/26 248/354.5 |
| 3,798,856 | A * | 3/1974 | Gloskowski | E04G 21/26 52/745.11 |
| 4,083,156 | A * | 4/1978 | Tye | E04G 21/26 403/379.5 |
| 5,590,863 | A * | 1/1997 | Sasaki | E04G 17/14 248/354.3 |
| 6,854,222 | B2 * | 2/2005 | Hansort | E04G 21/26 403/258 |
| 6,976,339 | B1 * | 12/2005 | Riccio | E04G 21/1841 52/127.2 |
| 7,665,252 | B2 * | 2/2010 | Lang | E04G 21/26 52/127.2 |
| 7,913,463 | B2 * | 3/2011 | Russell | E04G 17/14 52/651.1 |
| 8,117,787 | B2 * | 2/2012 | Lee | E04G 25/061 403/109.5 |
| 9,476,525 | B2 * | 10/2016 | Tarpy | F16L 9/04 |
| 11,091,923 | B2 * | 8/2021 | Recker | E04G 21/165 |
| 2009/0101774 | A1 * | 4/2009 | Shih | E04G 25/065 248/200.1 |
| 2011/0079698 | A1 * | 4/2011 | Pezzimenti | E04G 21/26 248/354.5 |

* cited by examiner

PUSH-PULL PROP

This application is a National Phase of International Application PCT/IB2021/055525 filed Jun. 23, 2021 which designated the U.S.

This application claims priority to Italian Patent Application No. 102020000015427 filed Jun. 26, 2020, which application is incorporated by reference herein.

TECHNICAL FIELD

The present invention relates to a push-pull prop.

The pull-push prop is a provisional work for the building and construction industry, which allows the stabilization and support of structures in a temporary and safe manner, during the steps of pouring or completion of the work.

BACKGROUND ART

In particular, the push-pull prop is interposed between two surfaces of formworks, panels, or prefabricated elements to keep the two surfaces in place during the construction, renovation, or remediation of a structure. The push-pull prop is typically used in the steps of concrete pouring.

Unlike the conventional props which work under compression to support horizontal surfaces, the pull-push prop is a type of prop which is arranged inclined with respect to the horizontal to support a vertical wall, or in any case generally arranged at an angle between two non-parallel surfaces, also working under traction.

The push-pull prop does not have standard dimensions but can adapt to the construction site and to the spaces in which it must operate by adjusting its length.

The length adjustment generally occurs by moving two mutually telescopically sliding tubes either away or towards each other, two tilting plates or brackets (also referred to as "shoes"), which allow the prop to be fixed to the surface to be propped, being connected at their ends.

Various forms of push-pull props exist today, which substantially differ from one another based on the type of adjustment they allow.

The "ring-nut" push-pull prop is the most common one; it comprises two telescopic sliding tubes provided with fixing holes at fixed intervals which are locked by means of a pin (or shaped hook) for the rough adjustment of the length, while the finer adjustment, which allows the precise adjustment of the fixing angle between the ground and the wall, is made by means of a threaded ring nut which moves the pin between two consecutive holes and thus moves the tubes (which do not rotate) axially closer or further apart.

However, this prop is particularly inconvenient and tiring to use because of the frictions between the ring nut and the various components, while the dimensions of the ring nut prevent compact storage and stacking when the prop is not in use.

Furthermore, the fine adjustment is limited in travel between two successive holes adapted to receive the locking pin for the rough adjustment.

Furthermore, the Applicant found that, for applications requiring a prop which can cover long distances of several meters, having a ring nut substantially arranged in the center of the prop is particularly inconvenient, because the operator who must carry out the fine adjustment, once the prop is arranged in place, struggles to reach the ring nut with his/her hands to perform the adjustment. Consider, for example, a 6-meter long prop arranged at 45°, in which the ring nut is arranged at a height of about 3 meters: the ring nut is inconvenient and thus unreachable unless a ladder is used.

Another widely used form of a push-pull prop is that including two tubes threaded at one end and screwed onto a common ring nut; in this case, by rotating the ring nut, it is possible to move apart the two tubes (which do not rotate) axially. In this case, however, the extent of the adjustment is dependent solely on the length of the ring nut, therefore if there is a need to reach long distances, it is necessary to proceed with a time-consuming and laborious unscrewing of the ring nut, which, however, will be limited by the length of the ring nut itself.

The Applicant also noted that it is difficult in the construction industry to find alternative prop solutions which are valid and efficient, due to the stringent regulations and construction standards which must be considered.

OBJECT OF THE INVENTION

In this context, it is the technical task underlying the present invention to suggest a push-pull prop which overcomes one or more of the drawbacks of the prior art mentioned above.

In particular, it is an object of the present invention to provide a push-pull prop which is structurally simple, practical to use, and allows an efficient adjustment of its length.

It is a further object of the present invention to suggest a push-pull prop which is solid, resistant to operating stresses, and durable over time.

The technical task and the specified objects are substantially achieved by a push-pull prop comprising the technical features set forth in one or more of the appended claims.

SUMMARY OF THE INVENTION

In particular, the present invention provides a push-pull prop comprising an inner tube and an outer tube reversibly fixed to each other, where the inner tube is at least partially inserted into the outer tube.

The prop comprises a threaded bar at least partially screwed into a threaded portion of a first end of the inner tube, where the first end of the inner tube is opposite to a second end of the inner tube inserted into the outer tube.

The inner tube, outer tube and threaded rod are arranged coaxially with one another along a common axis of the prop, defining in use the inclination angle of the prop with the horizontal.

In particular, the prop comprises a fixing head comprising, in turn, a coupling portion and a locking portion.

The coupling portion is either fixed or fixable to a first end of the outer tube, where the first end of the outer tube is opposite to a second end of the outer tube adapted to receive the inner tube.

Advantageously, the locking portion is rotationally connected to the coupling portion, so that the outer tube can rotate with respect to the locking portion about a rotation axis of the outer tube coincident with the common axis of the prop to either screw or unscrew the inner tube on the threaded rod.

Advantageously, the locking portion is further configured to rotationally connect to a first connecting element of the prop at a first surface to be propped, so that the prop can rotate about a first tilting axis of the prop perpendicular to the rotation axis of the outer tube.

Advantageously, the threaded bar is configured to rotationally connect to a second connecting element of the prop at a second surface to be propped, so that the prop can rotate about a second tilting axis of the prop perpendicular to the rotation axis of the outer tube and parallel to the first tilting axis of the prop.

Advantageously, the fixing head comprises an anti-friction sliding element in the shape of a solid material ring, interposed between the coupling portion and the locking portion, and a retaining element of the anti-friction sliding element between the coupling portion and the locking portion.

Therefore, the push-pull prop of the present invention can be arranged inclined between the two surfaces to be propped, connecting thereto by means of the connecting elements, and its length can be adjusted simply by rotating the outer tube either clockwise or counterclockwise so as to tension the prop against the two surfaces.

Once the inner tube has been roughly fixed to the outer tube according to the desired prop length, rotating the outer tube (and thus also the inner tube fixed thereto) allows a fine adjustment of the prop by simply screwing/unscrewing the threaded rod inside the inner tube effortlessly and conveniently.

Therefore, by virtue of the present invention, the length adjustment is not dependent on the use of any ring nut, which is often difficult to achieve in applications for long lengths.

Indeed, the outer tube, or the inner tube, can be advantageously grasped at any point along its extension to carry out the adjustment.

Furthermore, by virtue of the presence of the anti-friction sliding element, the rotation is easy and effortless without the need for additional tools, thus allowing a convenient and practical adjustment for any operator even in the most inconvenient construction site situations.

The dependent claims, incorporated herein by reference, correspond to different embodiments of the invention.

Further features and advantages of the present invention will become more apparent from the following indicative and thus non-limiting description of a preferred, but not exclusive embodiment of a push-pull prop, as shown in the accompanying drawings.

DETAILED DESCRIPTION OF PREFERRED EMBODIMENTS OF THE INVENTION

Figure 1:
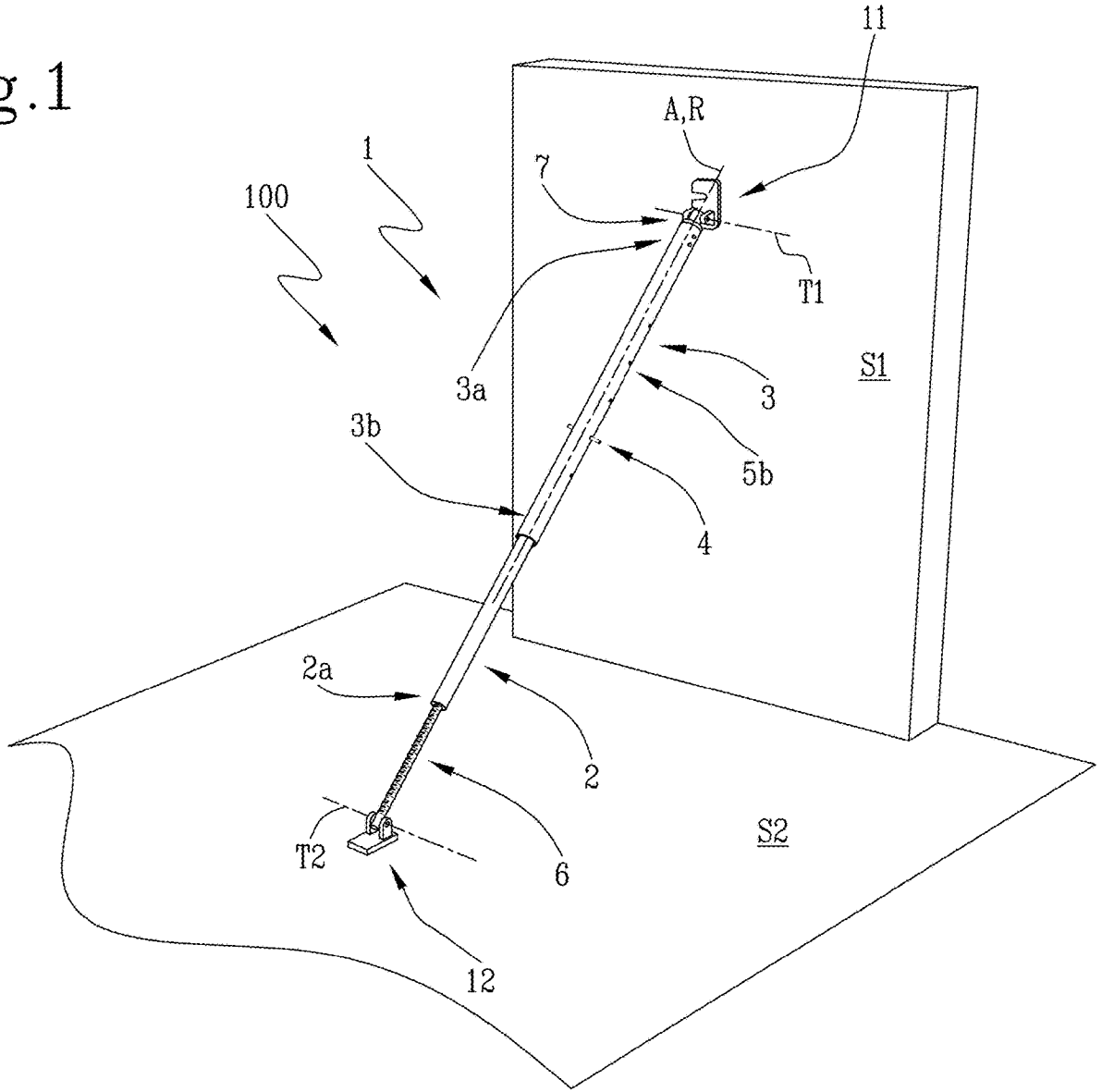
FIG. 1 is a diagrammatic perspective view of a push-pull prop according to the present invention, during a configuration of use.

With reference to the accompanying figures, a push-pull prop is indicated by reference numeral 1 as a whole, henceforth simply referred to as prop 1.

As shown in FIG. 1, the prop 1 is configured to be arranged inclined between two surfaces S1, S2 to be propped (e.g., two perpendicular surfaces, in the case of soil/floor/slab S2 and wall S2).

The prop 1 comprises an inner tube 2 and an outer tube 3 which are reversibly fixed to each other, where the inner tube 2 is at least partially inserted into the outer tube 3.

Preferably, the prop 1 comprises a locking pin 4 passing through the inner tube 2 and the outer tube 3 at an overlapping zone of the inner tube 2 and outer tube 3 to prevent the reciprocal movement thereof.

In other words, the inner tube 2 is fixed to the outer tube 3 by inserting the locking pin 4 into respective through-holes 5*a*, 5*b* of the tubes 2, 3 so that the two tubes 2, 3, when constrained by the locking pin 4, are integral in movement.

The first adjustment of the prop 1, i.e. the "rough" one, can thus be carried out by the operator by causing the inner tube 2 to slide into the outer tube 3, selecting and aligning the through-holes 5*a*, 5*b*, and inserting the locking pin 4 so as to lock the tubes 2, 3 at the desired length.

The prop 1 then comprises a threaded bar 6 at least partially screwed into a threaded portion of a first end 2*a* of the inner tube 2, opposite to a second end 2*b* of the inner tube 2 inserted into the outer tube 3.

In other words, the inner tube 2 is screwable onto the threaded bar 6 (and therefore even onto the outer tube 3 when constrained by the inserted locking pin 4), and the inner tube 2 is interposed between the threaded bar 6 and the outer tube 3.

Figure 2:
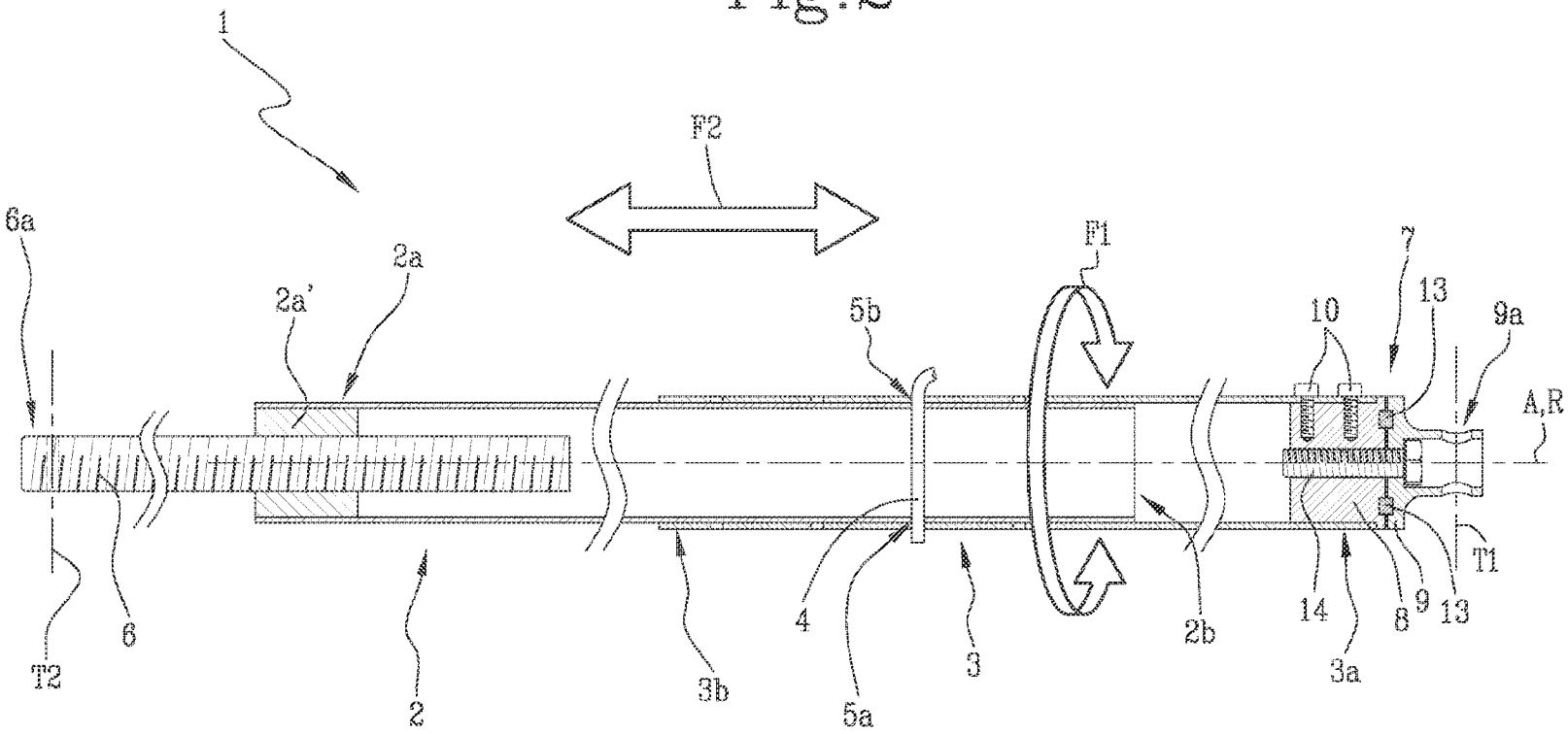
FIG. 2 is a diagrammatic section of the push-pull prop shown in FIG. 1.

Preferably, with reference to FIG. 2, the threaded portion of the first end 2*a* of the inner tube 2 is a threaded bushing 2*a*' fixed or fixable inside the inner tube 2. Therefore, the threaded bar 6 is threaded specifically to be screwed into the threaded bushing 2*a*'.

In particular, the inner tube 2, outer tube 3 and threaded bar 6 are arranged coaxially to one another along a common axis A of the prop 1.

Typically, the common axis A lies on a plane perpendicular to the surfaces S1, S2 to ensure proper placement of the prop, thus substantially defining the inclination angle of the prop 1 with respect to the surfaces S1, S2.

The prop 1 of the present invention comprises a fixing head 7. The fixing head 7 comprises a coupling portion 8 and a locking portion 9.

The coupling portion 8 is either fixed or fixable to a first end 3*a* of the outer tube 3, opposite to a second end 3*b* of the outer tube 3 adapted to receive the inner tube 2.

Figure 3:
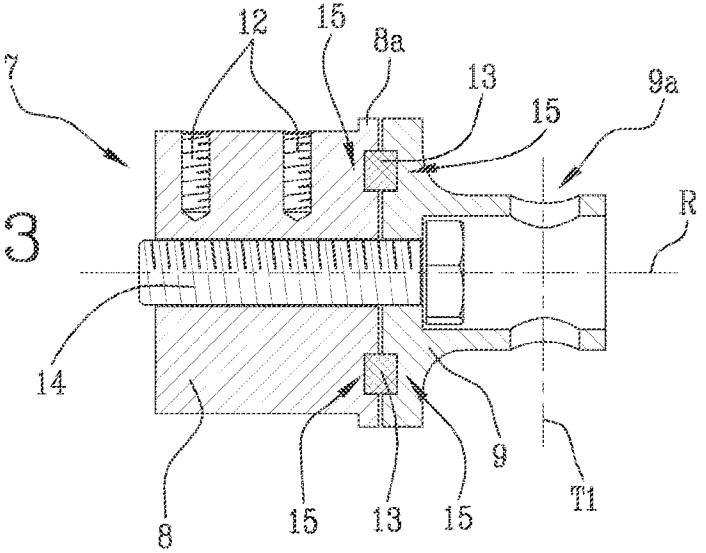
FIGS. 3 and 3A show a diagrammatic cross-section and an exploded perspective view, respectively, of a fixing head of the push-pull prop of the present invention as shown in FIGS. 1 and 2.
Figure 3A:
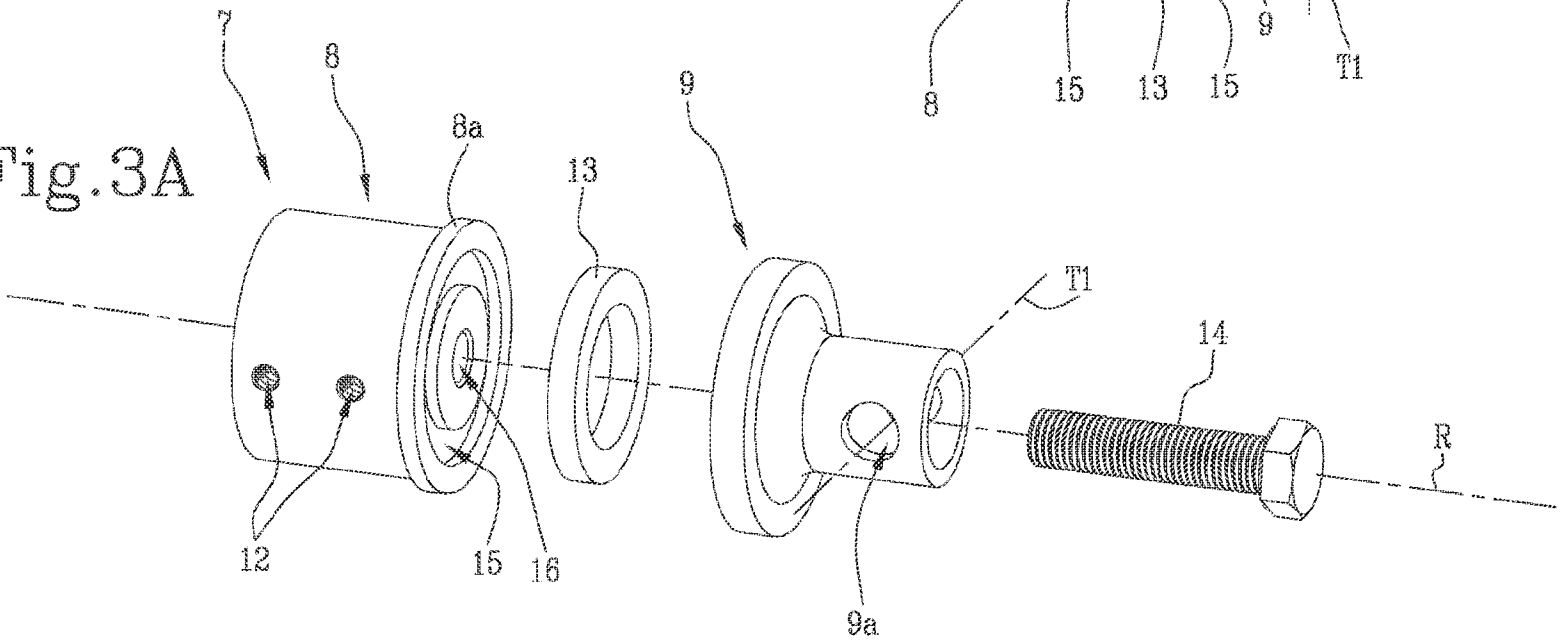

Preferably, the coupling portion 8 is fixed to the first end 3*a* of the outer tube 3 by means of a plurality of screws 10, shown in FIG. 2, passing through the outer tube 3 and insertable into corresponding holes 12 of the coupling portion 8, shown in FIGS. 3 and 3A.

Furthermore, with reference to FIG. 2, the coupling portion 8 is preferably inserted, in use, at least partially into the first end 3*a* of the outer tube 3. In other words, the first end 3*a* of the outer tube 3 is fitted onto the coupling portion 8.

With reference to FIGS. 3 and 3A, even more preferably, the coupling portion 8 comprises a raised peripheral ring 8*a* against which the edge of the first end 3*a* of the outer tube 3 abuts, as shown in FIG. 2.

Advantageously, the locking portion 9 is rotationally connected in use to the coupling portion 8, so that the outer tube 3 (and thus even the inner tube 2 fixed thereto) can rotate (as indicated by arrow F1 in FIG. 2) with respect to the locking portion 9 about a rotation axis R of the outer tube 3 coincident with the common axis A of the prop 1 to screw or unscrew the inner tube 2 on the threaded rod 6 by increasing or decreasing the longitudinal extension of the prop 1.

Indeed, screwing or unscrewing the inner tube 2 on the threaded bar 6 at the threaded portion allows the threaded bar 6 and the outer tube 3 to be moved closer or further apart (as indicated by arrow F2 in FIG. 2) to finely adjust the compression/pulling of the prop 1 on the surfaces S1, S2.

It is worth noting that in the prop 1 according to the present invention, the threaded rod 6 and the locking portion 9 remain fixed with respect to the rotation of the "coupling portion 8-outer tube 3-inner tube 2" system.

Furthermore, advantageously:

- the locking portion 9 is configured to rotationally connect to a first connecting element 11 of the prop 1 at the first surface S1 to be propped, so that the prop 1 can rotate about a first tilting axis T1 of the prop 1 perpendicular to the rotation axis R of the outer tube 3, and
- the threaded bar 6 is configured to rotationally connect to a second connecting element 12 of the prop 1 at the second surface S2 to be propped, so that the prop 1 can rotate about a second tilting axis T2 of the prop 1 perpendicular to the rotation axis R of the outer tube 3 and parallel to the first tilting axis T1 of the prop 1.

In other words, the locking portion 9 and the threaded rod 6 can rotate only about the tilting axes T1, T2, respectively, to change the inclination angle of the prop 1 upon the rotation of the outer tube 3.

In particular, the connecting elements 11 and 12 are fixed or fixable to the respective surfaces S1, S2 and thus remain in a fixed position during the rotation of the rotation axis R and/or the tilting axes T1, T2.

Preferably, the coupling portion 9 of the fixing head 7 has a respective connection slot 9*a* adapted to receive a first connecting pin, not shown in the accompanying figures, of the prop 1 with the first connecting element 11 along the first tilting axis T1, and the threaded bar 6 has a respective connection slot 6*a* adapted to receive a second connecting pin, not shown in the accompanying figures, of the prop 1 with the second connecting element 12 along the second tilting axis T2.

With particular reference to FIGS. 3 and 3A, the fixing head 7 of the prop 1 of the present invention advantageously comprises:

- an anti-friction sliding element 13 in the shape of a solid material ring, e.g. made of bronze, interposed between the coupling portion 8 and the locking portion 9, and
- a retaining element 14 configured to retain the anti-friction sliding element 13 between the coupling portion 8 and the locking portion 9.

In particular, the anti-friction sliding element 13 preferably is a bronze ring operating as a bushing.

The bronze ring offers excellent resistance and self-lubrication characteristics, whereby it ensures optimal resistance to stresses and an effective guarantee against breakage, thus facilitating the mutual sliding between the coupling portion 8 and the locking portion 9.

Advantageously, the anti-friction sliding element 13 also allows the coupling portion 8 and the locking portion 9 to be spaced apart so that they are not in contact with each other, i.e., preventing friction during the rotation of the coupling portion 8 with respect to the locking portion 9.

Indeed, the prop 1 is typically made of metal and the attrition between the coupling portion 8 and the locking portion 9 would make it difficult (if not impossible, considering the working loads to which prop 1 is axially subjected) to rotate the outer tube 3.

Therefore, the anti-friction sliding element 13 allows obtaining an effective rotation of the coupling portion 8 fixed in use to the outer tube 3, and thus the rotation of the outer tube 3, ensuring an ideal sliding without compromising the robustness and durability of the system.

Due to the asymmetrical distribution of forces to which prop 1 is subjected, unlike a normal bearing which does not work axially under ideal conditions and is therefore easily subject to breakage, the ring shape made of solid material particularly allows withstanding very high stresses, such as those to which prop 1 is subjected during operation.

In order to allow the rotation of the "coupling portion 8-outer tube 3-inner tube 2" assembly, considering that neither the locking portion 9 nor the threaded rod 6 can rotate about the rotation axis R (being preferably fixed to the first and second surfaces S1, S2, respectively, by means of the first and second connecting elements 11, 12), a component of the prop 1, namely the fixing head 7, which easily rotates (preferably idle) in a practical and frictionless manner is required.

Advantageously, the retaining element 14, e.g. a screw, serves the function of keeping the locking portion 9 and the coupling portion 8 coupled while allowing them to slide reciprocally in rotation.

In particular, as shown in the accompanying figures, the anti-friction sliding element 13 is coaxial to the retaining element 14.

In other words, the retaining element 14 performs the function of packing the coupling portion 8 and the locking portion 9; in particular, in order to avoid the unscrewing of the retaining element 14, a welding spot can be made after installing it. As an alternative to the screw, a self-locking nut or a pin or a nut provided with a split pin can be used.

Preferably, the coupling portion 8 and the locking portion 9 have respective ring-shaped housing seats 15 mutually facing and spaced apart to house the anti-friction sliding element 13.

Advantageously, the anti-friction sliding element 13 is thus confined and protected within the housing seats 15, in which it is free to slide upon the rotation of the outer tube 3.

With reference to the embodiment shown in the accompanying figures, the coupling portion 8 is preferably defined by a substantially cylindrical solid body having a through-hole 16 in which the retaining element 14 is inserted or insertable.

In particular, the through-hole 16 extends about the common axis A.

According to a further aspect of the present invention, a push-pull prop installation kit 100 is provided, comprising:

- a push-pull prop 1 according to the present invention, where the locking portion 9 and the threaded bar 6 have respective connection slots 9*a*, 6*a*,
- a first and a second connecting element 11, 12 which can be fixed to the first and second surfaces S1, S2 to be propped, respectively, and having respective through-holes (not shown in the figures) which can be coupled to the respective connection slots 9*a*, 6*a*,
- a first and a second connecting pin (not shown in the accompanying figures) which can be inserted through the connection slots 9*a*, 6*a* and the through-holes, respectively, to be arranged along the first and second tilting axes T1, T2 of the prop 1.

It is worth noting that, advantageously, the prop 1 can also be installed backwards, i.e. with the fixing head 7 connected to the second connecting element 12 and with the threaded rod 6 connected to the first connecting element 11.

The present invention achieves the suggested purposes, overcoming the drawbacks complained of in the prior art and providing the user with a push-pull prop which is particularly efficient, practical in its use, and small in size, and with an installation kit which is simple and quick to install.

The invention claimed is:

1. A push-pull prop comprising:

an inner tube and an outer tube which are reversibly fixed to each other, wherein the inner tube is at least partially inserted into the outer tube, a threaded bar at least partially screwed into a threaded portion of a first end of the inner tube, said first end being opposite to a second end of the inner tube inserted into the outer tube, said inner tube, outer tube and threaded bar being arranged coaxially to one another along a common axis of the prop, a fixing head comprising a coupling portion fixed or fixable to a first end of the outer tube, said first end being opposite to a second end of the outer tube adapted to receive the inner tube, and a locking portion rotationally connected to said coupling portion, so that said outer tube is rotatable with respect to said locking portion about a rotation axis of the outer tube coinciding with the common axis of the prop in order to screw or unscrew said inner tube on or from said threaded bar, said locking portion of the prop being further configured to rotationally connect to a first connecting element of the prop at a first surface to be propped, so that the prop is rotatable about a first tilting axis of the prop perpendicular to the rotation axis of the outer tube;

wherein said threaded bar is configured to rotationally connect to a second connecting element of the prop at a second surface to be propped, so that the prop is rotatable about a second tilting axis of the prop perpendicular to the rotation axis of the outer tube and parallel to the first tilting axis of the prop;

wherein said fixing head comprises:

an anti-friction sliding element shaped as a solid material ring, interposed between the coupling portion and the locking portion, and a retaining element of the anti-friction sliding element between the coupling portion and the locking portion, wherein said anti-friction sliding element is a bronze ring operating as a bushing and wherein said retaining element is a screw.

2. The push-pull prop according to claim 1, wherein the coupling portion and the locking portion have respective ring-shaped housing seats mutually facing and spaced apart to accommodate the anti-friction sliding element.

3. The push-pull prop according to claim 1, wherein the coupling portion is defined by a substantially cylindrical solid body having a through-hole in which the retaining element is inserted or insertable.

4. The push-pull prop according to claim 1, wherein said coupling portion is inserted at least partially into the first end of the outer tube.

5. The push-pull prop according to claim 1, wherein said threaded portion of the first end of the inner tube is a threaded bushing fixed or fixable inside the inner tube.

6. The push-pull prop according to claim 1, wherein said locking portion has a respective connection slot adapted to receive a first connecting pin of the prop with the first connecting element along the first tilting axis of the prop, and wherein said threaded bar has a respective connection slot adapted to receive a second connecting pin of the prop with the second connecting element along the second tilting axis of the prop.

7. The push-pull prop according to claim 1, comprising a locking pin passing through the inner tube and the outer tube at an overlapping zone of the inner tube and outer tube to prevent reciprocal movement thereof.

8. A kit for installing a push-pull prop comprising:

the push-pull prop according to claim 1, wherein said locking portion and said threaded bar have respective connection slots, a first and a second connecting element which are fixable to a first and a second surface to be propped, respectively, and having respective through holes configured to be coupled to said connection slots, a first and a second connecting pin which are insertable through said connection slots and said through holes, respectively, to be arranged along said first and second tilting axes of the prop.

* * * * *